US006329051B1

(12) United States Patent
Groh et al.

(10) Patent No.: US 6,329,051 B1
(45) Date of Patent: Dec. 11, 2001

(54) BLOWABLE INSULATION CLUSTERS

(75) Inventors: Zivile M. Groh, Sommerville; Victor P. Laskorski, N. Attleborough, both of MA (US)

(73) Assignee: Albany International Corp., Albany, NY (US)

( * ) Notice: Subject to any disclaimer, the term of this patent is extended or adjusted under 35 U.S.C. 154(b) by 0 days.

(21) Appl. No.: 09/300,028

(22) Filed: Apr. 27, 1999

(51) Int. Cl.[7] ..... D21B 1/04; D04H 1/00

(52) U.S. Cl. ..... 428/360; 442/340; 442/344; 442/351; 442/327; 428/360; 428/361; 428/375; 428/378

(58) Field of Search ..... 442/327, 416, 442/340, 351, 344; 428/360, 375, 378, 361; 264/116

(56) References Cited

U.S. PATENT DOCUMENTS

| | | |
|---|---|---|
| Re. 27,587 | 2/1973 | Paliyenko et al. . |
| 1,714,240 | 5/1929 | Rayner . |
| 2,314,482 | 3/1943 | De Fries . |
| 2,339,431 | 1/1944 | Slayter . |
| 2,713,547 | 7/1955 | Frederick . |
| 2,923,980 | 2/1960 | Steinruck . |
| 2,958,919 | 11/1960 | Palmer . |
| 3,046,173 | 7/1962 | Copeland . |
| 3,373,455 | 3/1968 | Kaplan . |
| 3,423,795 | 1/1969 | Watson . |
| 3,461,026 | 8/1969 | Schick . |
| 3,511,747 | 5/1970 | Davies . |
| 3,589,956 | 6/1971 | Krantz et al. . |
| 3,654,055 | 4/1972 | Gray . |
| 3,702,260 | 11/1972 | Jayne et al. . |
| 3,733,245 | 5/1973 | Veazey et al. . |
| 3,772,137 | 11/1973 | Tolliver . |
| 3,828,934 | 8/1974 | Green et al. . |

(List continued on next page.)

FOREIGN PATENT DOCUMENTS

| | | |
|---|---|---|
| 2 065 728A | 7/1981 | (GB) . |
| 364703 | 5/1976 | (SU) . |
| WO 89/04886 | 6/1989 | (WO) . |
| WO 96/10665 | 4/1996 | (WO) . |

OTHER PUBLICATIONS

International Search Report for PCT/US00/11335 prepared by EPO, dated Aug. 2, 2000.

*Primary Examiner*—Cheryl Juska
(74) *Attorney, Agent, or Firm*—Pitney, Hardin, Kipp & Szuch LLP

(57) ABSTRACT

A blowable insulation material comprising batt shredded into blowable clusters. In preferred embodiments, the clusters comprise water repellant or lubricant finished fiber and/or dry fiber and/or binder fiber and may be mixed with opened fiber. A process to produce the blowable clusters is also disclosed.

11 Claims, 3 Drawing Sheets

U.S. PATENT DOCUMENTS

| | | | | |
|---|---|---|---|---|
| 3,892,909 | | 7/1975 | Miller . | |
| 3,923,942 | | 12/1975 | Nishiumi et al. . | |
| 4,040,371 | | 8/1977 | Cooper et al. . | |
| 4,065,599 | * | 12/1977 | Nishiumi et al. | 428/402 |
| 4,118,531 | | 10/1978 | Hauser . | |
| 4,129,675 | | 12/1978 | Scott . | |
| 4,144,294 | | 3/1979 | Werthaiser et al. . | |
| 4,164,534 | | 8/1979 | Ogino . | |
| 4,167,604 | | 9/1979 | Aldrich . | |
| 4,248,927 | | 2/1981 | Liebman . | |
| 4,259,400 | | 3/1981 | Bolliand . | |
| 4,293,604 | | 10/1981 | Campbell . | |
| 4,304,817 | | 12/1981 | Frankosky . | |
| 4,364,996 | | 12/1982 | Sugiyama . | |
| 4,400,426 | * | 8/1983 | Aldrich | 428/290 |
| 4,401,610 | | 8/1983 | Ohberg . | |
| 4,413,030 | | 11/1983 | Tesch et al. . | |
| 4,418,103 | | 11/1983 | Tani et al. . | |
| 4,468,336 | | 8/1984 | Smith . | |
| 4,477,515 | | 10/1984 | Masuda et al. . | |
| 4,481,256 | | 11/1984 | Masuda et al. . | |
| 4,540,625 | | 9/1985 | Sherwood . | |
| 4,551,378 | | 11/1985 | Carey, Jr. . | |
| 4,555,421 | | 11/1985 | Yasue . | |
| 4,588,635 | | 5/1986 | Donovan . | |
| 4,618,531 | | 10/1986 | Marcus . | |
| 4,681,789 | | 7/1987 | Donovan et al. . | |
| 4,783,364 | | 11/1988 | Ilan . | |
| 4,794,038 | | 12/1988 | Marcus . | |
| 4,814,229 | | 3/1989 | Tesch . | |
| 4,818,599 | | 4/1989 | Marcus . | |
| 4,820,574 | | 4/1989 | Tesch . | |
| 4,886,693 | | 12/1989 | Haranoya et al. . | |
| 4,911,980 | | 3/1990 | Tesch . | |
| 4,917,943 | | 4/1990 | Tesch . | |
| 4,921,645 | * | 5/1990 | Insley | 264/6 |
| 4,940,502 | | 7/1990 | Marcus . | |
| 4,992,327 | | 2/1991 | Donovan et al. . | |
| 4,998,309 | | 3/1991 | Tesch . | |
| 5,043,207 | | 8/1991 | Donovan et al. . | |
| 5,057,168 | | 10/1991 | Muncrief . | |
| 5,064,689 | | 11/1991 | Young, Sr. et al. . | |
| 5,080,964 | | 1/1992 | Tesch . | |
| 5,082,711 | | 1/1992 | Goerens . | |
| 5,112,684 | | 5/1992 | Halm et al. . | |
| 5,123,949 | | 6/1992 | Thiessen . | |
| 5,169,580 | | 12/1992 | Marcus . | |
| 5,218,740 | | 6/1993 | Synder et al. . | |
| 5,238,612 | | 8/1993 | Halm et al. . | |
| 5,286,556 | | 2/1994 | Tesch . | |
| 5,294,392 | | 3/1994 | Marcus . | |
| 5,329,868 | | 7/1994 | Tesch . | |
| 5,338,500 | | 8/1994 | Halm et al. . | |
| 5,344,707 | | 9/1994 | Synder . | |
| 5,458,971 | | 10/1995 | Hernandez et al. . | |
| 5,491,186 | * | 2/1996 | Kean et al. | 524/13 |
| 5,492,580 | | 2/1996 | Frank . | |
| 5,500,295 | | 3/1996 | Halm et al. . | |
| 5,516,580 | * | 5/1996 | Frennette et al. | 428/288 |
| 5,589,536 | * | 12/1996 | Golino et al. | 524/593 |
| 5,620,541 | | 4/1997 | Herzberg . | |
| 5,624,742 | | 4/1997 | Babbitt et al. . | |
| 5,659,911 | | 8/1997 | Kirkbride et al. . | |
| 5,683,811 | * | 11/1997 | Hernandez et al. | 428/373 |
| 5,719,228 | * | 2/1998 | Taylor et al. | 524/593 |
| 5,851,665 | | 12/1998 | Marcus . | |
| 6,053,999 | * | 4/2000 | Marcus | 156/73.2 |
| 6,077,883 | * | 6/2000 | Taylor et al. | 523/217 |
| 6,232,249 | * | 5/2001 | Kawada | 442/352 |

* cited by examiner

BLOWABLE INSULATION CLUSTERS

FIELD OF THE INVENTION

The invention relates to down-like insulating clusters and a method for manufacturing the same.

BACKGROUND OF THE INVENTION

There have been many attempts to achieve an insulating material having down-like qualities for use in insulating articles such as clothing, sleeping bags, comforters, and the like. Prior efforts to develop a feasible material have most often yielded those that are too heavy and dense to be considered down-like and/or difficult to blow through conventional equipment.

U.S. Pat. No. 5,624,742 to Babbitt et al. describes a blowing insulation that comprises a blend of first and second insulating (glass) fiber materials. One of the groups of fibers is smaller in size for filling the voids between the fibers of the larger group.

U.S. Pat. No. 3,892,919 to Miller describes a filling material using larger cylindrical or spherical formed fiber bodies along with feathery formed bodies which are mixed together with the latter relied upon to fill the voids.

U.S. Pat. No. 4,167,604 to Aldrich describes an improved thermal insulation material that is a blend of down and synthetic fiber staple formed from hollow polyester filaments which may be treated with silicone and formed into a carded web.

U.S. Pat. No. 4,248,927 to Liebmann describes an insulating material comprising a combination of natural feathers and downs, and synthetic polyesters formed into a web.

U.S. Pat. No. 4,468,336 to Smith describes loose fill insulation that is blown into spaces. The insulation material comprises a mixture of loose fill cellulosic insulation mixed with a staple fiber.

U.S. Pat. No. 5,057,116 to Muncrief describes insulation formed by blending binder fibers with insulative fibers. The insulative fibers are selected from the group consisting of synthetic and natural fibers formed into a batt which may be cut into any desired shape.

U.S. Pat. No. 5,458,971 to Hernandez et al describes a fiber blend useful as a fiberfill in garments. The fiberfill blend comprises crimped hollow polyester fiber and crimped binder fibers.

U.S. Pat. No. 4,040,371 to Cooper et al describes a polyester fiber filling material comprising a blend of polyester staple fibers with organic staple fibers.

U.S. Pat. No. 5,492,580 to Frank describes a material formed by blending a mix of first thermoplastic, thermoset, inorganic, or organic fibers with second thermoplastic fibers.

U.S. Pat. No. 4,588,635 to Donovan discloses a superior synthetic down and has particular reference to light-weight thermal insulation systems which can be achieved by the use of fine fibers in low density assemblies and describes a range of fiber mixtures, that, when used to fabricate an insulating batt, provides advantageous, down-like qualities such as a high warmth-to-weight ratio, a soft hand, and good compressional recovery. This material approaches, and in some cases might even exceed the thermal insulating properties of natural down. From a mechanical standpoint, however extremely fine fibers suffer from deficiencies of rigidity and strength that make them difficult to produce, manipulate and use. Recovery properties of such a synthetic insulator material are enhanced at larger fiber diameters, but an increase in the large fiber component will seriously reduce the thermal insulating properties overall. The problems associated with mechanical stability of fine fiber assemblies are exacerbated in the wet condition since surface tension forces associated with the presence of capillary water are considerably greater than those due to gravitational forces or other normal use loading and they have a much more deleterious effect on the structure. Unlike waterfowl down, the disclosed fiber combination described provides excellent resistance to wetting.

U.S. Pat. No. 4,992,327 to Donovan et al discloses the use of binder fiber components to improve insulator integrity without compromising desired attributes. More specifically the invention disclosed therein relates to synthetic fiber thermal insulator material in the form of a cohesive fiber structure, which structure comprises an assemblage of: (a) from 70 to 95 weight percent of synthetic polymeric microfibers having a diameter of from 3 to 12 microns; and (b) from 5 to 30 weight percent of synthetic polymeric macrofibers having a diameter of 12 to 50 microns, characterized in that at least some of the fibers are bonded at their contact points, the bonding being such that the density of the resultant structure is within the range 3 to 16 kg/m$^3$, the thermal insulating properties of the bonded assemblage being equal to or not substantially less than the thermal insulating properties of a comparable unbonded assemblage. The reference also describes a down-like cluster form of the preferred fiber blends. The distinct performance advantages of the cluster form over the batt form are also disclosed in the patent.

However, prior art clusters often are generally hand fabricated in a slow, tedious, batch process. Furthermore, the prior art materials are not easily blowable materials which can be used with conventional manufacturing equipment. Therefore there is a need for a blowable material which may be used as a partial or full replacement for down which may be manufactured and blown using conventional equipment.

SUMMARY OF THE INVENTION

It is therefore a principal object of the invention to overcome the shortcomings of the materials heretofore mentioned.

It is a further object of the invention to provide a blowable material for use as a partial replacement or a complete replacement for down.

The invention disclosed herein are clusters made from shredded batt. The batt may be a heatset batt which preferably comprises water repellant finished or lubricant finished fiber and/or dry fiber and/or binder fiber. The batt is then mechanically shredded into small clusters which can be blown through conventional equipment. The somewhat random shape of the clusters allows for better packing resulting in a more uniform filling. In a preferred embodiment, a composite material of both water repellant finished and/or lubricant finished fiber and dry fiber is opened and then blended with the clusters to provide a blowable material which has a lofty nature, good compressional properties, and improved hand when compared to the use of clusters alone.

DETAILED DESCRIPTION OF THE INVENTION

Figure 1B:
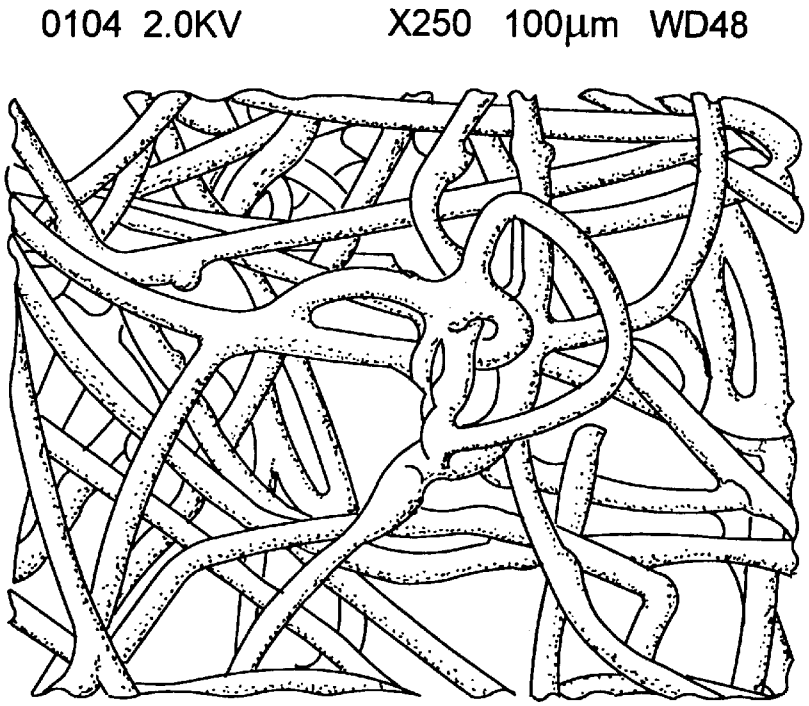
FIG. 1*b* shows a frontal view magnified by SEM of the invention shown in FIG. 1*a*.

The inventive material comprises clusters made from a shredded batt. The batt may or may not be a heatset batt, depending on the composition of the batt. The batt preferably contains water repellant finished or lubricant finished fiber and/or dry fiber and/or binder fiber. The batt is then mechanically shredded one or more times into small clusters which are blowable and have desired down-like qualities. It is contemplated that a web (generally a single layer material) and batt (generally a multi-layer material), or portions thereof may be used to make the inventive clusters. Following by way of example is a description of methods of manufacturing the clusters.

The clusters may be made with a light-weight card sliver made with a suitable binder-fiber blend. The fiber-blend is preferably the fiber-blend disclosed in U.S. Pat. No. 4,992,327 to Donovan et al., the disclosure of which is incorporated herein by reference. As aforesaid, this patent discloses an insulation material where microfibers are bonded together to form a support structure for microfibers. Bonding may also be between both macrofibers and some of the microfibers at their various contact points. Preferably, however, bonding is between macrofibers at their contact points. This provides a supporting structure which contributes significantly to the mechanical properties of the insulation material. Also, the fiber structure generally comprises from 70 to 95 weight percent of synthetic polymeric microfibers having a diameter of from 3 to 12 microns and from 5 to 30 weight percent of synthetic polymeric macrofibers having a diameter of 12 to 50 microns. Other preferred embodiments utilize fiber-blends comprising water repellant finished or lubricant finished fiber and/or dry fiber and/or binder fiber. The sliver is first collected at the output side of a card in cans commonly used for this purpose and passes directly through heated tubes that would thermally bond the binder fiber mixture. It is important that the bonding step is completed without shrinking and densifying the lofty card sliver. Each sliver-end falls through a vertical tube, while centered by guide rings, as heated air blows upward through the tube, bonding the lofty, linear, fiber assembly. Upon exit from the heated tube, the sliver is drawn to the entry side of a guillotine-type staple fiber cutter. A clean cut, without the densifying effects of fiber fusion at the cut, is achieved. This method results in a collection of very lofty fiber clusters.

The above method was tested utilizing long, thin slices of ⅞ inch thick, 4 oz/yd PRIMALOFT® batt (PRIMALOFT® ONE), rather than card sliver. PRIMALOFT® batt is a cross-lapped, bonded structure, consisting of a fiber blend of the kind described in Donovan et al as discussed above and is commercially available. Strips of batt, approximately ⅞ inch wide, were cut along the crossmachine direction (CD), making the fiber orientation generally parallel to the length of the strip and like card sliver in this regard. The strips taken from PRIMALOFT® batt were previously bonded and thus had sufficient integrity to feed easily into the cutter. It is believed that bonding prior to cutting also improved the quality of the cut. The staple cutter used, a laboratory unit manufactured by Ace Machinery Co. of Japan and designated Model No. C-75, was set to cut at ⅞ inch intervals. It cleanly cut the PRIMALOFT® feed stock into a collection of cluster-like cubes (each approximately ⅞×⅞×⅞ inch). The density of the cluster collection appeared to be significantly less than 0.5 lb/ft$^3$, making it down-like and a very weight-efficient insulator. The PRIMALOFT® batt used as feed stock had a nominal density of 0.5 lb/ft$^3$ and virtually no densification was observed during cutting.

Figure 1A:
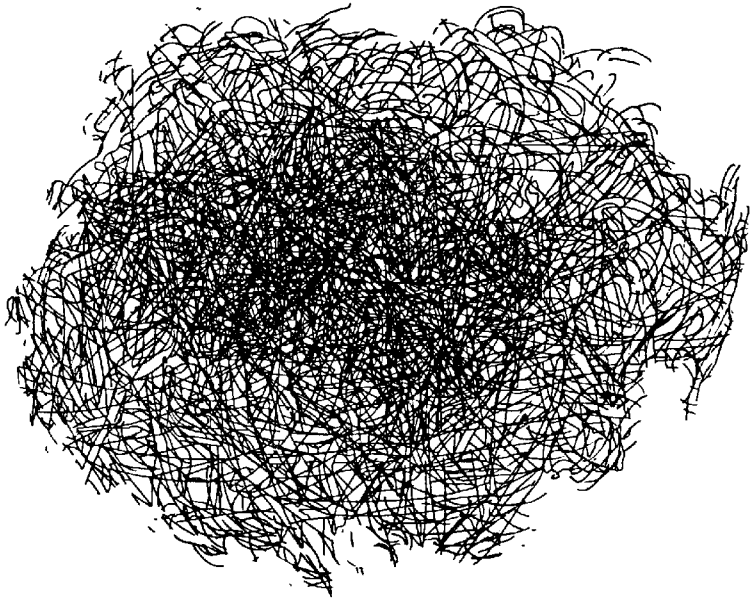
FIG. 1*a* shows a frontal view of a preferred embodiment of the invention.

The preferred method uses batt consisting of plied card-laps, although other fibrous forms may be equally suitable. The card-laps or webs, are preferably formed into batt with densities comparable to the densities characteristic of down. The card-laps or webs are prepared from binder fiber and/or dry fiber and/or water repellant fibers of 0.5–6.0 denier. In this preferred method, the card-laps or webs comprise 40% binder fiber, 30% 1.4 denier dry fiber, and 30% 1.4 denier water repellant fiber. These selected fibers are preferably carded into a 3 oz./sq. yd. Assembly by means of a single cylinder metallic card with stationary flats. These cards may be obtained from Hollingsworth Saco Lowell of Greenville, S.C. The output of the card is sent through electric and/or gas fired sources of heat to heatset the binder fiber. The batt is heated for a time and temperature sufficient to cause the fiber to bond. In this case the temperatures used were between 300–400° F. The now heatset batt is then shredded, preferably two times in a Rando Opener Blender (made by the Rando Machine Company of Macedon, N.Y.) to form the inventive clusters. FIGS. 1*a* and 1*b* are frontal views of the clusters, twice shredded which shows the random nature of the fibers bonded at various contact points which make up the structure of the cluster.

The preferred method uses batt consisting of plied card-laps, although other fibrous forms may be equally suitable. The card-laps or webs, are preferably formed into batt with densities comparable to the densities characteristic of down. The card-laps or webs are prepared from binder fiber and/or dry fiber and/or water repellant fibers of 0.5–6.0 denier. In this preferred method, the card-laps or webs comprise 40% binder fiber, 30% 1.4 denier dry fiber, and 30% 1.4 denier water repellant fiber. These selected fibers are preferably carded into a 3 oz./sq. yd. assembly by means of a single cylinder metallic card with stationary flats. These cards may be obtained from Hollingsworth Saco Lowell of Greenville, S.C. The output of the card is sent through electric and/or gas fired sources of heat to heatset the binder fiber. The batt is heated for a time and temperature sufficient to cause the fiber to bond. In this case the temperatures used were between 300–400° F. The now heatset batt is then shredded, preferably two times in a Rando Opener Blender (made by the Rando Machine Company of Macedon, N.Y.) to form the inventive clusters. FIGS. 1*a* and 1*b* are frontal views the clusters, twice shredded.

Other variances include:

1. Increasing staple length up to the cardable limit to improve integrity and durability of the clusters;
2. Changing binder fiber content to "fine-tune" shreddability, cuttability, cohesiveness, and the performance characteristics of the clusters;
3. Varying the size, shape and aspect ratios of the clusters;
4. Using ultra sonic bonding means if suitable for purpose;
5. Shredding the clusters more than once;
6. Using batt that is not heatset; and
7. Shredding only portions of batt or web.

It has been observed that the twice shredded clusters are smoother and more easily blendable than clusters which are shredded only once. Further it is possible to take strips or sliver of heatset batt which may have been slitted, and then take these portions through a standard shredding process to form clusters.

Several variances from the examples given above will be possible, and may be desirable, without departing from the scope of the invention.

MATERIALS EVALUATION

Figure 2B:
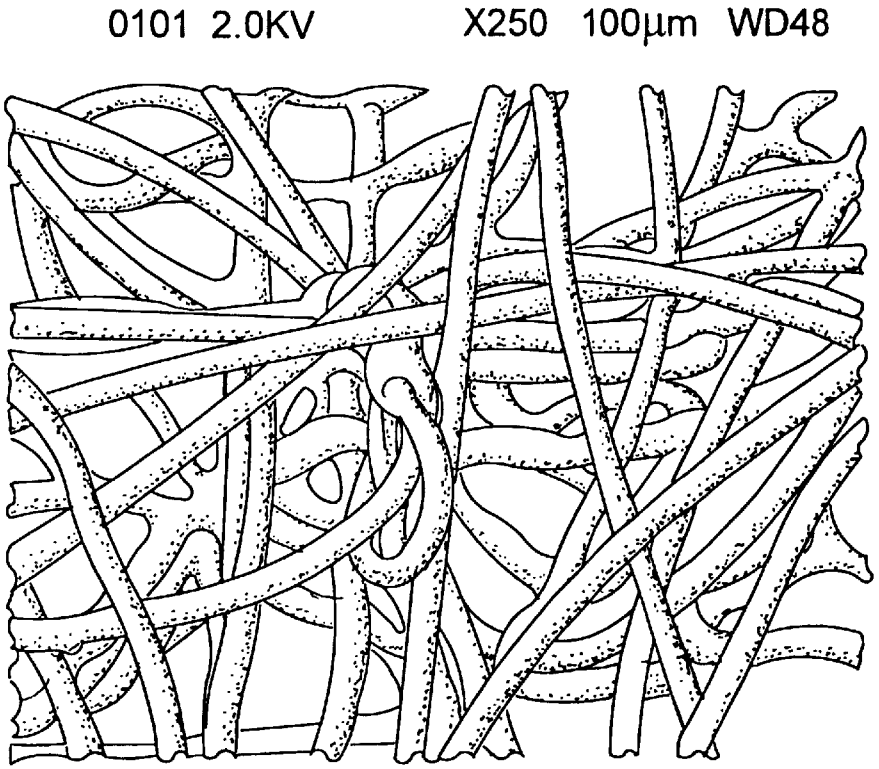
FIG. 2*b* shows a frontal view magnified by SEM of the invention shown in FIG. 2*a*.
Figure 2A:
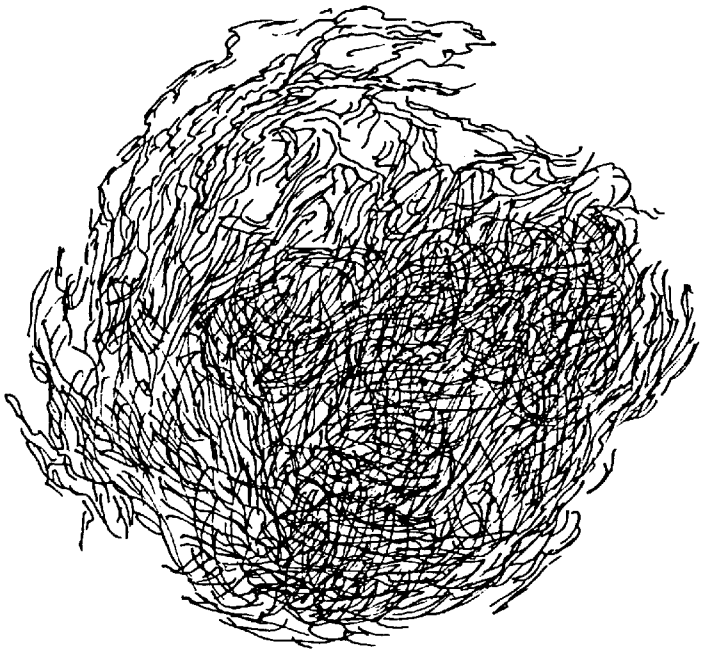
FIG. 2*a* shows a frontal view of a second preferred embodiment of the invention.

FIGS. 2*a* and 2*b* show a preferred embodiment of the clusters which are further enhanced by blending the clusters with opened 100% synthetic fiber, preferably a mixture of pre-blended water repellant or lubricant finished fiber and dry fiber. The opened fiber is preferably any mixture of 0.5 to 6.0 den fiber. Water repellant or lubricant finished fiber has enhanced water resistance. In preferred embodiments, the clusters comprise no more than 50% of the material. In some embodiments, the opened fiber may also be a mixture of 70–95% 0.1–1.4 den fiber and 5–30% 1.4–24 den fiber. In alternate embodiments, the opened fiber is a 50/50 mixture of 1.4 den water repellant or lubricant finished polyester 1.4 den dry polyester.

Test 1

Properties of Clusters

Twenty five (25) lbs. of twice shredded batt comprising 30% water repellant or lubricant finished fiber, 30% dry fiber, and 40% binder fiber was emptied into a mixing tank of a blowing station. The shredded batt alone opened up quite readily once the beaters in the tank were turned on and passed though the metering and blowing system without any problems.

Similar results were observed with the mixture of clusters and opened fiber. Blow nozzle sizing may compensate for this. In some cases, hand blending may also be incorporated to enhance the properties of the mixtures.

The ability to resist water absorption is an area where the clusters are superior to down. Tests were conducted to measure the loft, water gain and density of synthetic blends after various soaking times in water.

Test 2

In end use, insulation materials are used in garments or sleeping bags. In order to represent a realistic wetting situation, the test materials were placed in fabric pillowcases prior to soaking. These pillowcases were 8"×9" and made of 3 oz/sq.yd. ripstop nylon sewn on three edges. The fourth edge was pinned with safety pins.

The materials tested were shredded batt alone, shredded batt with antistatic treatment, 50/50 synthetic fiber/shredded batt and 50/50 synthetic fiber/shredded batt with antistatic treatment. 12 grams of insulation material was placed in each pillowcase; three replicates were filled of each material type. The initial loft and weight of each sample was measured and recorded.

Figure 3:
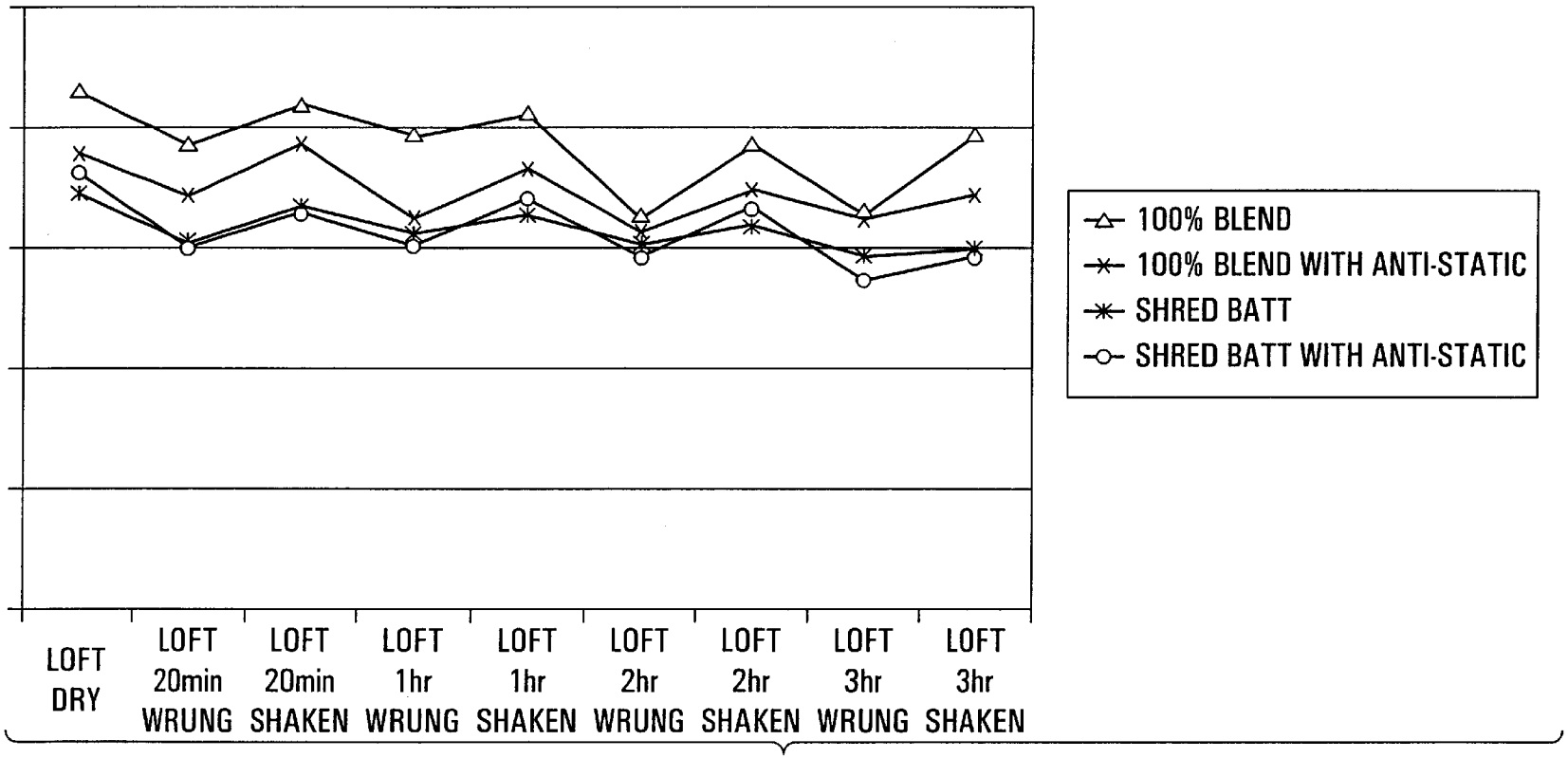
FIG. 3 shows a comparison graph of loft after soaking materials.
Figure 4:
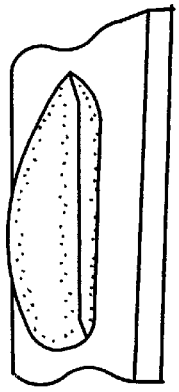
FIG. 4 shows a photograph of loft after soaking materials.

Each sample was first submerged in 70° F. water for 10 seconds, then allowed to remain floating in the water for 20 minutes. At that time, each sample was run through an industrial wringer once and loft was measured. Each sample was then shaken vigorously for 10 seconds and loft was again recorded. The samples were then submerged again for 10 seconds, and the process repeated so that measurements could be made after 1, 2 and 4 hours of total soaking exposure. FIG. 3 shows a graph comparing the effect on loft by soaking exposure. FIG. 4 is a picture showing the loft of 50/50 synthetic fiber/shredded batt after four hours of soaking, wringing and shaking.

The clusters (alone mixed with synthetic fiber) show superior water resistance and are enhanced by washing and do not result in clumping typical in material filled with down alone.

It is noted that the use of clusters and clusters in admixture with opened fibers may result in some static electricity in the product that had to be addressed. For example, two boxes of fabric softening sheets and a can of static removal spray were added to a mixture similar to the mixture of Test 1. The sheets were cut into ½" squares and sprinkled into the product. The tank and surface of the product were liberally sprayed with the static removal spray. At this point the product was successfully blown through the system. A section of duct (larger than the nozzle) was used to provide an accurate metered weight. With the proper adjustments to the appropriate equipment, the clusters in admixture with the opened fiber may be used. It is sometimes necessary to treat the fiber (before shredding) with a static removal treatment.

The invention further contemplates utilizing synthetic fiber blends that are not discussed above. These blend ranges limit average fiber diameter to ensure a high level of insulating performance. In some instances, an average fiber diameter greater than that defined by the cited patents may be desirable. For example, relatively large diameter fibers may be utilized if the end product is a pillow or upholstery and compressional stiffness is an important requirement.

Thus by the present invention its advantages will be realized and although preferred embodiments have been disclosed and described in detail herein, its scope should not be limited thereby rather its scope should be determined by that of the appended claims.

What is claimed is:

1. A blowable insulation material comprising one or more of the materials taken from the group consisting of bonded batt, bonded web, a portion of bonded batt, and a portion of bonded web shredded one or more times into random shaped blowable clusters which are comprised of random fibers bonded together at a plurality of contact points between fibers.

2. The blowable insulation material according to claim 1 wherein the batt comprises from 70 to 95 weight percent of synthetic polymeric microfibers having a diameter of from 3 to 12 microns and from 5 to 30 weight percent of synthetic polymeric macrofibers having a diameter of 12 to 50 microns.

3. The blowable insulation material of claim 1 further comprising static removal means.

4. The blowable insulation material according to claim 1 wherein the batt comprises one or more of the materials from the group consisting of 0.5–6.0 denier water repellant or lubricant finished fiber, 0.5–6.0 denier dry fiber, and binder fiber.

5. The blowable insulation material according to claim 4 wherein the batt comprises 40% binder fiber, 30% dry fiber, 30% water repellant or lubricant finished fiber.

6. The blowable insulation material of claim 4 further comprising static removal means.

7. The blowable insulation material of claim 1 wherein the blowable cluster are in admixture with one or more of the man made materials from the group consisting of opened water repellant fiber, lubricant finished fiber, and dry fiber.

8. The admixture of claim 7 wherein the clusters comprise no more than 50% of the admixture.

9. The admixture of claim 7 wherein the dry fiber is dry polyester and the water repellant or lubricant finished fiber is siliconized polyester.

10. The admixture of claim 7 wherein the opened water repellant or lubricant finished fiber/dry fiber mixture is a 50/50 blend.

11. The admixture of claim 7 further comprising static removal means.

* * * * *